US007998278B2

(12) United States Patent
Hackenberger et al.

(10) Patent No.: US 7,998,278 B2
(45) Date of Patent: Aug. 16, 2011

(54) ACIDIC COMPOSITION BASED ON SURFACTANT BLEND

(75) Inventors: Tanja Hackenberger, Dorsten (DE); Claudia Caussin De Schneck, Düsseldorf (DE); Annett Lossack, Villigen (CH)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/438,307

(22) PCT Filed: Aug. 21, 2006

(86) PCT No.: PCT/EP2006/065483

§ 371 (c)(1),
(2), (4) Date: Nov. 20, 2009

(87) PCT Pub. No.: WO2008/022650

PCT Pub. Date: Feb. 28, 2008

(65) Prior Publication Data

US 2010/0069285 A1 Mar. 18, 2010

(51) Int. Cl.

| | |
|---|---|
| ***B08B 3/04*** | (2006.01) |
| ***C23G 1/02*** | (2006.01) |
| ***C11D 1/825*** | (2006.01) |
| ***C11D 3/22*** | (2006.01) |
| ***C11D 7/08*** | (2006.01) |
| ***C11D 7/36*** | (2006.01) |

(52) U.S. Cl. ..... 134/22.11; 134/23; 134/24; 134/32; 134/39; 134/42; 510/421; 510/470; 510/474; 510/535

(58) Field of Classification Search ..... 510/421, 510/470, 474, 535; 134/22.11, 23, 24, 32, 134/39, 42

See application file for complete search history.

(56) References Cited

U.S. PATENT DOCUMENTS

| | | | | |
|---|---|---|---|---|
| 5,780,416 | A * | 7/1998 | Kiewert et al. | 510/422 |
| 2003/0064903 | A1 | 4/2003 | Coughlin et al. | |

FOREIGN PATENT DOCUMENTS

| | | | |
|---|---|---|---|
| DE | 4233699 | | 4/1994 |
| DE | 4415804 | | 11/1995 |
| GB | 2416773 | * | 2/2006 |
| WO | WO99/50380 | | 10/1999 |
| WO | WO 2006/136774 | * | 12/2006 |
| WO | WO2006/136774 | | 12/2006 |

* cited by examiner

*Primary Examiner* — Brian P Mruk
(74) *Attorney, Agent, or Firm* — Merchant & Gould P.C.

(57) ABSTRACT

The present invention refers to a concentrate for use in a cleaning and/or washing process comprising a) an alkyl glycoside having the general formula $R^1OG_n$ whereby G is a saccharide residue and n is 1, 2, 3, 4 or 5 and $R^1$ is an alkyl group or alkylene group having 1 to 20 carbon atoms, and b) a nonionic alkylene oxide adduct, wherein the concentrate has a pH value of less than 6.5, as well as to a solution obtained by diluting the concentrate and to a process of cleaning objects using the concentrate and/or solution.

9 Claims, No Drawings

ACIDIC COMPOSITION BASED ON SURFACTANT BLEND

The present invention refers to an acidic composition based on a surfactant blend as well as to a process of cleaning an object, using the aforementioned acidic composition.

There is an increasing demand in the art for the development of suitable compositions and processes to clean articles. Especially, there is an increasing demand for suitable compositions which can be used for "cleaning in place" (CIP) processes. CIP is very often used for cleaning pipelines in which a cleaning composition can be circulated or a vessel that can be sprayed with a minimum of a cleaning composition for obtaining a satisfactory cleaning result.

Typically, a CIP system includes a solution reservoir, a supply pump and a return circuit if applied in a tank or other similar vessels. A spray device and some type of return pump may also be included. The cleaning process, whereby a cleaning solution is put through a spray device in order to wash a vessel which is then directed to a drain or to a pipeline directly leading to the drain could be considered to be a CIP, as no re-circulation is established.

The success in cleaning vessels or pipeline circuits in place depends on 5 factors: time, temperature, pressure, concentration and mechanics. The time aspect refers to the length of time during which a temperature circulation is established.

If industrial systems have to be cleaned containing carbon dioxide the alkaline cleaning compositions tend to absorb the carbon dioxide very rapidly causing an underpressure in the closed system. This can result in an implosion of the pipelines and vessels to be cleaned. Alkaline cleaning compositions used for cleaning articles are suitable in CIP cleaning processes only if the carbon dioxide in the system is removed. The removal of carbon dioxide is time consuming and extends the cleaning time during which the facility does not work. Therefore alkaline cleaning compositions are not well suitable for cleaning in a carbon dioxide atmosphere.

Moreover, a cleaning composition used for a CIP cleaning must be low in foaming, since otherwise the cleaning result would not be satisfactory. However, the addition of foam depressors very often is not a suitable means to control foaming, since these foam depressors may detrimentally effect the cleaning result.

Cleaning compositions for cleaning articles are known in the art, especially a large number of alkaline cleaning compositions is used. Said cleaning compositions very often contain a surfactant.

One example of an alkaline cleaning composition is disclosed in WO 99/21948 in which a mixture of surfactants is used. WO 99/21948 discloses a blend of hexyl glycosides with a high amount of a surface active nonionic alkylene oxide adduct as a hydrotrope. Due to the alkaline pH value of said composition, the cleaning of pipelines or vessels which are used for liquids containing carbonic acid is not possible.

The technical problem underlying the present invention is the provision of a concentrate, a cleaning solution as well as a process for cleaning objects, whereby the replacement of carbon dioxide is not necessary. Moreover, the compositions used must be low in foam since otherwise the cleaning results may not be satisfactory.

The technical problem underlying the present invention is solved by a concentrate for using in a cleaning and/or washing process comprising a) an alkyl glycoside having the general formula I $$R^1OG_n \quad (I)$$

whereby G is a saccharide residue and n is 1, 2, 3, 4 or 5 and $R^1$ is an alkyl group or alkylene group having 1 to 20 carbon atoms, and b) a nonionic alkylene oxide adduct, wherein the concentrate has a pH value (20° C.) of less than 6.5.

In a preferred embodiment $R^1$ in general formula I is a linear or a branched alkyl or alkenyl group. Preferably the alkyl or alkenyl group $R^1$ comprises 1, 2, 3, 4, 5, 6, 7, 8, 9, 10, 11, 12, 13, 14, 15, 16, 17, 18, 19, 20 carbon atoms.

In a further preferred embodiment, the nonionic alkylene oxide adduct of the concentrate has the general formula II $$R^2O(AO)_xH \quad (II)$$

wherein $R^2$ is a linear or branched alkyl group or linear or branched alkenyl group having 1 to 24 carbon atoms, A is a $C_mH_{2m}$ group and m is 2 to 5. In a further preferred embodiment m is 2, 3, 4, 5.

Preferably $R^2$ is a linear or branched alkyl group or a linear or branched alkenyl group having 1, 2, 3, 4, 5, 6, 7, 8, 9, 10, 11, 12, 13, 14, 15, 16, 17, 18, 19, 20, 21, 22, 23, 24 carbon atoms.

Preferably the concentrate is an aqueous concentrate.

The amount of alkyl glycoside present in the concentrate preferably is 0.1 to 70% by weight, preferably 0.2 to 50% by weight and most preferred 0.5 to 30 wt-% of the concentrate. In a further preferred embodiment the amount of nonionic alkylene oxide adduct present in the concentrate is 0.01-35% by weight, preferably 0.03 to 25 wt-% and most preferred 0.05 to 20 wt-%.

The concentrate further comprises an acid being preferably an organic acid and/or inorganic acid. The acid preferably is selected from the group consisting of phosphoric acid, sulfuric acid, nitric acid, formic acid, acetic acid, propanoic acid, glycolic acid, citric acid, maleic acid, lactic acid, gluconic acid, alkanesulphonic acid, amidosulphonic acid, succinic acid, glutaric acid, adipic acid, phosphonic acid, polyacrylic acid or mixtures thereof. The pH value (20° C.) of the concentrate preferably is 6.0 or less, preferably 5.5 or less, even more preferred 5.0 or less, preferably 4.5 or less, even more preferred 4.0 or less, preferably 3.5 or less, even more preferred 3.0 or less, preferably 2.5 or less, preferably 2.0 or less, even more preferred 1.5 or less, preferably 1.0 or less, even more preferred 0.5 or less.

The concentrate may further comprise an additive being preferably selected from the group consisting of an additive being preferably selected from the group consisting of carriers, detergents, surfactants, builder, sequestering agents, defoamer, complexing agents, clear rinsing agents, disinfectants, antimicrobial compounds, corrosion inhibitors and mixtures thereof.

A further embodiment of the present invention is a solution obtainable by diluting the concentrate with a suitable diluent preferably being water. The ratio of concentrate to diluent may be from 1:10 to 1:10.000, preferably 0.5:100 to 5:100.

In a preferred embodiment the solution has a pH value (20° C.) of less than 6.5. Preferably the solution has a pH value (20° C.) of 6.0 or less, preferably 5.5 or less, even more preferred 5.0 or less, preferably 4.5 or less, even more preferred 4.0 or less, preferably 3.5 or less, even more preferred 3.0 or less, preferably 2.5 or less, preferably 2.0 or less, even more preferred 1.5 or less, preferably 1.0 or less, even more preferred 0.5 or less.

The concentrate may be diluted for obtaining the solution with any apparatus being customary to a person skilled in the art.

A further object of the present invention is the use of the concentrate and/or solution in a cleaning and/or washing process, being preferably a cleaning in place (CIP) process.

The process of cleaning objects comprises diluting the concentrate with a suitable diluent for obtaining a solution and contacting the object with the solution obtained.

Alternatively a solution having a position as described above may directly be contacted with the object to be cleaned.

The process of cleaning objects in a cleaning in place (CIP) process may be conducted with a known equipment configuration. The concentrate and/or the solution may be injected to the equipment via a solution or concentrate reservoir, a supply pump and a return circuit. Alternatively, the concentrate and/or the cleaning solution may be put through a spray device to wash a vessel and then directed to the drain or to a pipe that is flushed.

Alternatively, no means of recirculation of the cleaning solution might be present in the equipment configuration.

Surprisingly, the concentrate and/or the solution of the present invention are very effective in cleaning in place applications. The cleaning performance is very good, whereby the concentrate and/or cleaning composition is very low in foam. Therefore, a secure cleaning of articles or objects is possible. Additionally, when the equipment is used for pumping liquids containing carbonic acid, like beverages such as beer, it is not necessary to replace carbon dioxide before cleaning. Therefore, a sufficient and fast cleaning is possible. Moreover the cleaning solution can easily be rinsed after cleaning.

The present invention is exemplified by the following examples.

EXAMPLES

1. Preparation of a Cleaning Concentrate 80 g of phosphoric acid (75%) are admixed with 1.5 g of a triphosphono methylamine having a low chloride content. 1 g alkyl glycoside and 1 g of a $C_8$, $C_{10}$, $C_{11}$ fatty alcohol ethoxylate. Said mixture is diluted with 15 g of demineralised water.

2. Cleaning Performance

Dissolution of "Brandhefe" (yeast from brewing beer) from a surface like metal glass or polymeric coatings. A surface is soiled with a yeast residue obtained by brewing beer. The soiled surface is cleaned with the cleaning composition according to the present invention. The cleaning composition exhibits a superior cleaning performance.

3. Determination of the Foam Behavior of Cleaning and Disinfection-Solutions for CIP Applications As the CIP applications are performed automatically a strong foam formation is considered to be a critical side effect. To avoid problems during cleaning as well as general application problems, the foam formation as a result of circulation processes is investigated.

A cleaning composition of the present invention is used for cleaning vessels and pipelines of a bottling plant. The cleaning performance of the cleaning composition was very good, whereby the cleaning solution is very low in foam.

4. Beer Foam Compatibility

This test is carried out to check whether the cleaning solution interacts with the beer foam. Traces of surfactants could destroy the foam in beer.

The beer foam behavior of an untreated 150 mL glass beaker is compared with a 150 mL glass beaker being cleaned with the inventive cleaning composition and rinsed subsequently with water.

The beer is poured in the cleaned glass beaker, the stability of the beer foam is observed and compared with an untreated glass. The test result is evaluated visually.

The beer foam of a glass cleaned with the inventive cleaning composition is very stable being comparable with the comparison sample.

The solution according to the present invention has an excellent cleaning performance with respect to the "Brandhefe" test.

Moreover, the cleaning solution of the present invention is very low in foam which can be seen from the foam behavior test. Additionally, the clean solution can be rinsed very well from the equipment cleaned and the beer foam compatibility is very good since the stability of the beer foam is comparable with an untreated glass.

The invention claimed is:

1. A concentrate for use in a cleaning-in-place (CIP) process comprising:

a) an alkyl glycoside having the general formula $$R^1OG_n$$

wherein G is a saccharide residue, n is 1, 2, 3, 4 or 5, and $R^1$ is an alkyl group having 1 to 20 carbon atoms, and b) a nonionic alkylene oxide adduct surfactant, c) an acid; and d) triphosphono methylamine, wherein the concentrate has a pH value of less than 2.0.

2. The concentrate of claim 1, wherein $R^1$ is a linear or branched alkyl or alkenyl group.

3. The concentrate of claim 1, wherein the nonionic alkylene oxide adduct surfactant has the general formula $$R^2O(AO)_xH$$

wherein $R^2$ is a linear or branched alkyl group or linear or branched alkenyl group having 1 to 24 carbon atoms, A is a $C_mH_{2m}$ group, m is 2 to 5, and x is degree of alkoxylation.

4. The concentrate of claim 1, wherein the concentrate is an aqueous concentrate.

5. The concentrate of claim 1, wherein the amount of alkyl glycoside present in the concentrate is 0.1 to 70% by weight.

6. The concentrate of claim 1, wherein the amount of nonionic alkylene oxide adduct surfactant present in the concentrate is 0.1 to 35% by weight.

7. The concentrate of claim 1, wherein the acid is selected from the group consisting of phosphoric acid, sulfuric acid, nitric acid, formic acid, acetic acid, propanoic acid, glycolic acid, citric acid, maleic acid, lactic acid, gluconic acid, alkanesulphonic acid, amidosulphonic acid, succinic acid, glutaric acid, adipic acid, phosphonic acid, polyacrylic acid, and mixtures thereof.

8. The concentrate of claim 1, further comprising an additive selected from the group consisting of carriers, detergents, surfactants, builders, sequestering agent, defoamers, complexing agents, clear rising agents, disinfectants, antimicrobial compounds, corrosion inhibitors, and mixtures thereof.

9. A method of cleaning an object in a clean-in-place (CIP) process comprising:

a) providing a concentrate composition comprising an alkyl glycoside having the general formula $$R^1OG_n$$

wherein G is a saccharide residue, n is 1, 2, 3, 4, or 5, and $R^1$ is an alkyl group or alkylene group having 1 to 20 carbon atoms;

b) a nonionic alkylene oxide adduct surfactant, c) an acid; and d) triphosphono methylamine;

wherein the concentrate has a pH value of less than 2.0;

e) diluting the concentrate to form a solution where the ratio of concentrate:diluent is from 1:10 to 1:10,000; and f) applying the solution to the object, wherein the object contains carbon dioxide.

* * * * *